US010910757B2

(12) United States Patent
Nakamura et al.

(10) Patent No.: US 10,910,757 B2
(45) Date of Patent: Feb. 2, 2021

(54) CONNECTOR HAVING SLIDABLE LOCKING COVER

(71) Applicant: Yazaki Corporation, Tokyo (JP)

(72) Inventors: Masatoshi Nakamura, Makinohara (JP); Kazuto Ohtaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/016,727

(22) Filed: Jun. 25, 2018

(65) Prior Publication Data

US 2018/0375247 A1 Dec. 27, 2018

(30) Foreign Application Priority Data

Jun. 26, 2017 (JP) ..... 2017-124123

(51) Int. Cl.
*H01R 13/506* (2006.01)
*H01R 13/56* (2006.01)
*H01R 13/58* (2006.01)

(52) U.S. Cl.
CPC ..... *H01R 13/506* (2013.01); *H01R 13/56* (2013.01); *H01R 13/582* (2013.01)

(58) Field of Classification Search
CPC ..... H01R 13/62933; H01R 13/62938; H01R 13/506; H01R 13/56
USPC ..... 439/157, 372
See application file for complete search history.

(56) References Cited

U.S. PATENT DOCUMENTS 5,876,227 A * 3/1999 Kashiyama ..... H01R 13/62905 439/157
6,155,884 A 12/2000 Sugiyama
8,057,245 B2 * 11/2011 Sakamaki ..... H01R 13/62933 439/157
9,774,127 B2 * 9/2017 Yamaki ..... H01R 13/506
2006/0281350 A1 * 12/2006 Yamamoto ..... H01R 13/4361 439/157
2011/0070763 A1 * 3/2011 Kobayashi ..... H01R 13/6295 439/345
2011/0230106 A1 * 9/2011 Shamoto ..... H01R 13/62938 439/892
2012/0208383 A1 * 8/2012 Kobayashi ..... H01R 13/6295 439/133
2013/0102168 A1 * 4/2013 Kobayashi ..... H01R 13/5213 439/141
2014/0134862 A1 * 5/2014 Itou ..... H01R 13/62944 439/157

(Continued)

FOREIGN PATENT DOCUMENTS

JP H07-298450 A 11/1995
JP H11-250973 A 9/1999
JP 2002-352897 A 12/2002

(Continued)

OTHER PUBLICATIONS

Apr. 16, 2019—(JP) Notification of Reasons for Refusal—App 2017-124123.

*Primary Examiner* — Abdullah A Riyami
*Assistant Examiner* — Marcus E Harcum
(74) *Attorney, Agent, or Firm* — Banner & Witcoff, Ltd.

(57) ABSTRACT

A connector includes a housing which is capable of holding one or more electric wires and a cover which is attached to an end part of the housing while sliding in a sliding direction and guides the electric wire extending from the end part of the housing in a predetermined direction.

1 Claim, 7 Drawing Sheets

(56) References Cited

U.S. PATENT DOCUMENTS

| | | | | |
|---|---|---|---|---|
| 2014/0273566 | A1* | 9/2014 | Allgood | H01R 13/516<br>439/157 |
| 2016/0204538 | A1* | 7/2016 | Matsuura | H01R 13/502<br>439/660 |

FOREIGN PATENT DOCUMENTS

| | | | | |
|---|---|---|---|---|
| JP | 2011-198516 | A | 10/2011 | |
| JP | WO 2013115414 | A1 * | 8/2013 | H01R 13/506 |

* cited by examiner

CONNECTOR HAVING SLIDABLE LOCKING COVER

CROSS REFERENCE TO RELATED APPLICATIONS

This application claims priority from Japanese Patent Application No. 2017-124123 filed on Jun. 26, 2017, the entire contents of which are incorporated herein by reference.

BACKGROUND OF THE INVENTION

Field of the Invention

The present invention relates to a connector including a housing which can hold one electric wire or a plurality of electric wires and a cover which is slid to be mounted in the housing and defines therein a space for guiding an electric wire extending from an end part of the housing in a predetermined direction.

Description of Related Art

In a related art, a connector is proposed which includes a housing which can hold an electric wire and a cover which protects the electric wire and regulates a routing direction of the electric wire. For example, one of connectors in the related art is configured such that the cover can slide and reciprocate between a standby position and an attachment position with respect to the housing, whereby the cover is smoothly assembled with the housing (for example, see the patent document 1: JP-A-2011-198516).

[Patent Document 1] JP-A-2011-198516

[Patent Document 2] JP-A-2002-352897

According to a related art, a connector is also proposed which has a lock structure for locking the cover to the housing to prevent that the cover assembled with the housing is separated unintentionally from the housing (for example, see see the patent document 2: JP-A-2002-352897). However, in a case where the connector has such a lock structure, once the cover is assembled with the housing, the separation operation may be complicated when the cover is separated from the housing for maintenance. In other words, when the cover is firmly assembled with the housing, the cover may not be easily separated from the housing.

SUMMARY

One or more embodiments provide a connector in which a cover can firmly assembled with a housing and the cover can be easily separated from the housing.

In an aspect (1), one or more embodiments provide a connector includes a housing which is capable of holding one or more electric wires and a cover which is attached to an end part of the housing while sliding in a sliding direction and guides the electric wire extending from the end part of the housing in a predetermined direction. The cover includes a pair of plate-shaped parts and a connection part connecting the pair of plate-shaped parts, an inlet part which is formed on circumferential edge portions of the pair of plate-shaped parts and introduces the electric wire to an space between the pair of plate-shaped parts, an outlet part which is formed on circumferential edge portions of the pair of plate-shaped parts and derives the electric wire outside therefrom so as to guide the electric wire in the predetermined direction, a first locking part which is engaged with the housing to regulate sliding of the cover in a direction opposite to the sliding direction, and a second locking part which is engaged with the housing to regulate widening of a distance between the pair of plate-shaped parts. The first locking part is positioned on an outside from an outer wall surface of the housing. The second locking part is positioned closer to the outlet part than the first locking part.

In an aspect (2), the cover includes an opening part extending from an edge of the plate-shaped part between the first locking part and the second locking part.

In an aspect (3), the first locking part is positioned adjacent to the opening part in the plate-shaped part.

In an aspect (4), the cover includes a projection part on an inner wall surface of the cover to reduce a gap between the cover and the outer wall surface of the housing, on an opposite side to the first locking part across the opening part.

In an aspect (5), the housing includes a projection part on the outer wall surface of the housing to reduce a gap between the cover and the outer wall surface of the housing, on a position corresponding to an opposite side to the first locking part across the opening part.

In an aspect (6), the opening part has a slit shape or an ellipse shape.

According to the aspect (1), the electric wire extends from the end part of the housing, and the cover slid and mounted (locked) in the end part is in a state where the first locking part regulates sliding in an opposite direction, and in a state where the second locking part regulates the widening of the distance between the pair of plate-shaped parts. Further, at the time of mounting, the first locking part is positioned on the outside from the outer wall surface of the housing. For this reason, for example, when the first locking part is operated to release the engagement between the first locking part and the housing (for example, a jig for releasing the engagement abuts on the first locking part), the operation is easily performed compared to a case where the first locking part is positioned on the inside from the outer wall surface of the housing. In addition, for example, in a case where the first locking part moves with respect to the housing at the time of locking and releasing, the movement is hardly obstructed by the housing. Additionally, the second locking part is provided in a position close to the outlet part from the first locking part. For this reason, although the cover receives the external force applied in a direction in which the outlet part is widened by the electric wire passing through the outlet part (that is, the distance between the pair of plate-shaped parts is widened) when the electric wire is routed, the second locking part regulates the widening, so as to prevent that the engagement between the first locking part and the housing is unintentionally released (which results in sliding in an opposite direction to mounting).

Therefore, in the connector having this configuration, the cover can be firmly assembled with the housing, and the cover can be easily separated from the housing.

According to the aspect (2), the first locking part and the second locking part are arranged to interpose the opening part. For this reason, for example, although the cover receives the external force applied in the direction in which the outlet part is widened by the electric wire passing through the outlet part (that is, the distance between the pair of plate-shaped parts is widened) so that the distance between the pair of plate-shaped parts is changed in the vicinity of the second locking part, the change can be absorbed by the opening part, and thus the change hardly influences the first locking part. Therefore, in the connector having this configuration, it can be further reliably prevented that the engagement between the first locking part and the housing is released unintentionally.

According to the aspect (3), for example, in a case where the jig for releasing is inserted into the opening part of the cover to release the engagement between the first locking part and the housing, the jig easily reaches the first locking part. Therefore, in the connector having this configuration, the operation that separates the cover from the housing is easily performed compared to a case where the opening part and the first locking part are separated.

According to the aspect (4), for example, in a case where the jig for releasing is inserted into the opening part of the cover to release the engagement between the first locking part and the housing (for example, see FIGS. 8A and 8B), when one side surface of the jig is supported by an edge (margin) of the opening part on a side where the projection part is provided, and the jig is rotated in a direction in which the first locking part is separated from the housing with the edge as a support point, the projection part can be pressed by the outer wall surface of the housing, and a large external force can be applied to the first locking part according to so-called the principle of leverage. Accordingly, the engagement between the first locking part and the housing can be easily released. Therefore, in the connector having this configuration, the engagement between the first locking part and the housing can be easily released compared to a case where such a projection part is not provided.

According to one or more embodiments, the connector can be provided in which the cover can be firmly assembled with the housing, and the cover can be easily separated from the housing.

Hereinbefore, the invention has been described simply. Further, by reading through the following described modes to carry out the invention (hereinafter, referred to as "embodiment") with reference to the accompanying drawings, details of the invention will be further clarified.

DETAILED DESCRIPTION

Hereinafter, a connector 1 according to an embodiment of the invention will be described with reference to the drawings.

Figure 1:
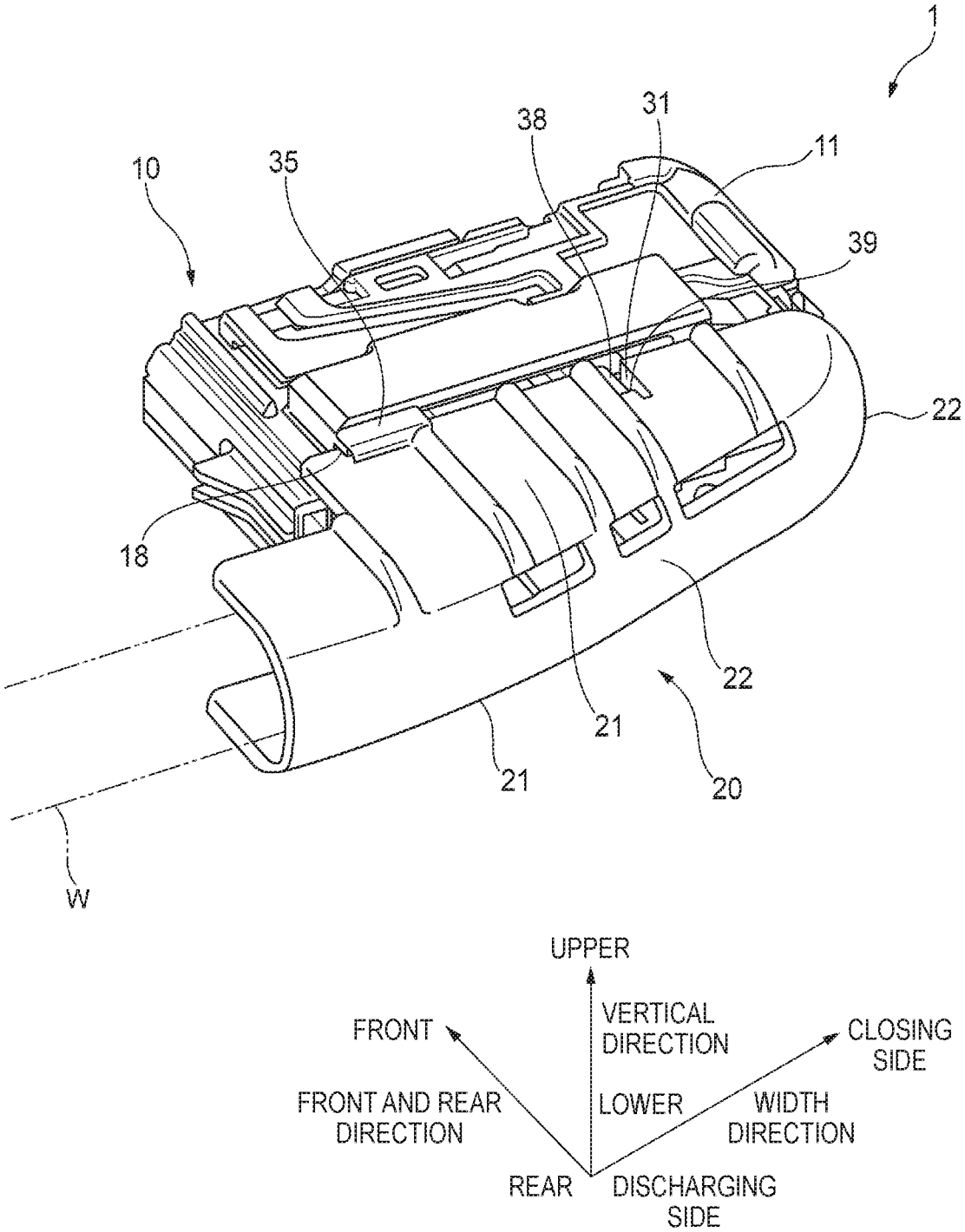
FIG. 1 is a perspective view illustrating a connector when viewed from a rear side.

As illustrated in FIG. 1, the connector 1 includes a housing 10, and a cover 20 mounted in the housing 10. Hereinafter, for convenience of description, "a front and rear direction", "a width direction", "a vertical direction", "a front side", "a rear side", "an upper side", "a lower side", "a discharging side" and "a closing side" are defined as illustrated in FIG. 1. "The front and rear direction", "the width direction", and "the vertical direction" are orthogonal to each other.

The cover 20 is a member which covers and protects a wire bundle W which extends from the end part (specifically, a rear end surface) of the housing 10 to the rear side, and bends the wire bundle W to the discharging side to guide the wire bundle in a discharging direction. The end part of the housing 10 is an outer circumferential portion of the housing 10 which is adjacent to the side surface (rear end surface) of the housing 10 in which the wire bundle W is drawn. The cover 20 is mounted in the rear end part of the housing 10 by sliding (moving in parallel) on the rear end part of the housing 10 from the closing side to the discharging side. Hereinafter, the housing 10 and the cover 20 will be described in order with reference to FIGS. 2A to 3C.

Figure 2A:
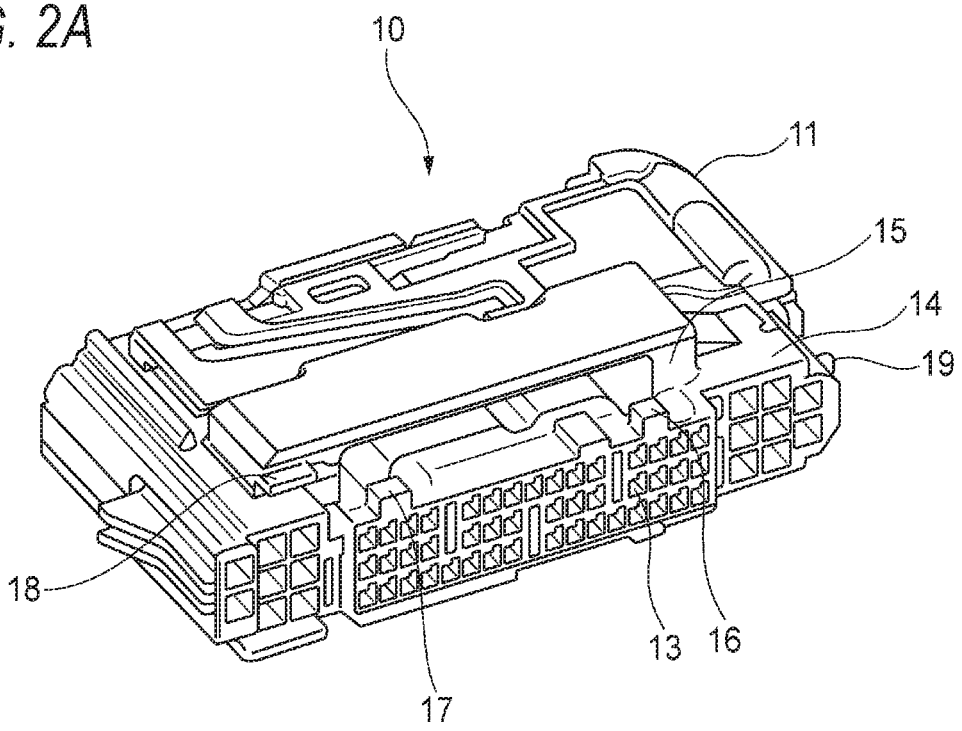
FIG. 2A is a perspective view illustrating a housing illustrated in FIG. 1 when viewed from the rear side.
Figure 2B:
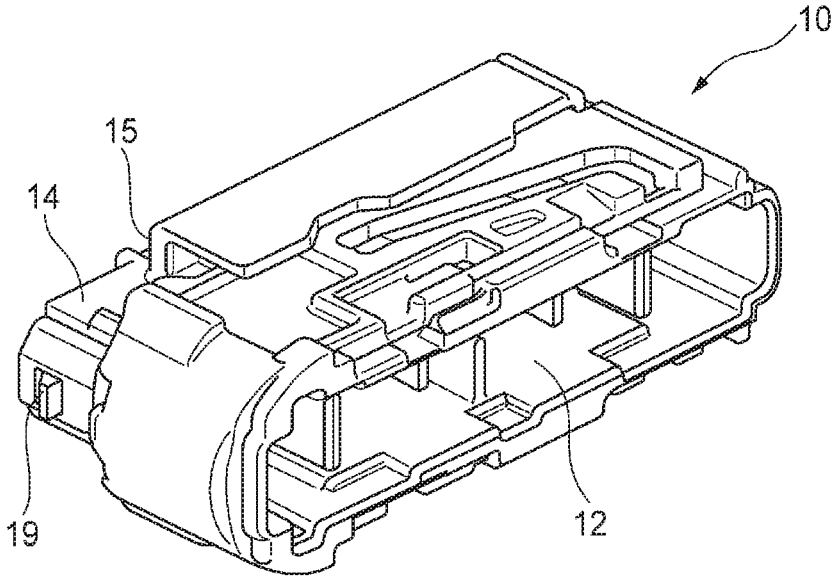
FIG. 2B is a perspective view illustrating the housing illustrated in FIG. 1 when viewed from a front side.

As illustrated in FIGS. 2A and 2B, the housing 10 is made of resin, and includes a rectangular cylindrical main circumferential wall part 11 which is long in the width direction. A plurality of terminal receiving chambers 13 which receive a plurality of terminals (not illustrated) connected in the end parts of the electric wires of the wire bundle W are formed on a rear end side of an inner space 12 of the main circumferential wall part 11 along the front and rear direction. The front end side of the main circumferential wall part 11 is opened. Through the opening, a housing (not illustrated) of a counterpart connector is fitted and fixed in the inner space 12 of the main circumferential wall part 11. Accordingly, the wire bundle W is electrically connected with a wire bundle which is connected in a terminal received in the housing of the counterpart connector.

In the rear end parts of the upper and lower surfaces of the main circumferential wall part 11, the surface directed to the upper side and the surface directed to the lower side (14) which extend in the width direction function as a pair of first guide surfaces 14 for guiding the cover 20 at the time of attaching the cover 20. Further, a pair of surfaces (15), which are formed by portions protruding from positions close to the rear end sides of the upper and lower surfaces of the main circumferential wall part 11 to the vertical outer sides, extend in the width direction and are directed to the rear side. The pair of surfaces function as a pair of second guide surfaces 15 for guiding the cover 20 at the time of attaching the cover 20.

In the first guide surfaces 14 extending in the width direction, first projections 16 projecting to the vertical outer sides are formed in positions close to the closing side, and second projections 17 projecting to the vertical outer sides are formed in positions close to the discharging side. That is, the first projection 16 and the second projection 17 are formed in parallel with a gap in a width direction. As illustrated below, the first projection 16 and the second projection 17 function to prevent that the cover 20 is deviated to the rear side after attachment. Further, the first projection 16 also functions to prevent that the cover 20 escapes to the closing side after attachment.

A rib 18 which projects to the rear side and extends in the width direction is formed in the discharging-side end part of the second guide surface 15 extending in the width direction. Further, a third projection 19 projecting to the closing side is formed in the rear end part of the side surface of the closing side of the main circumferential wall part 11. As illustrated below, a pair of ribs 18 function to prevent that the cover 20 is opened to the vertical outer sides after attachment, and the third projection 19 functions to prevent that the cover 20 is deviated to the rear side after attachment.

Figure 3A:
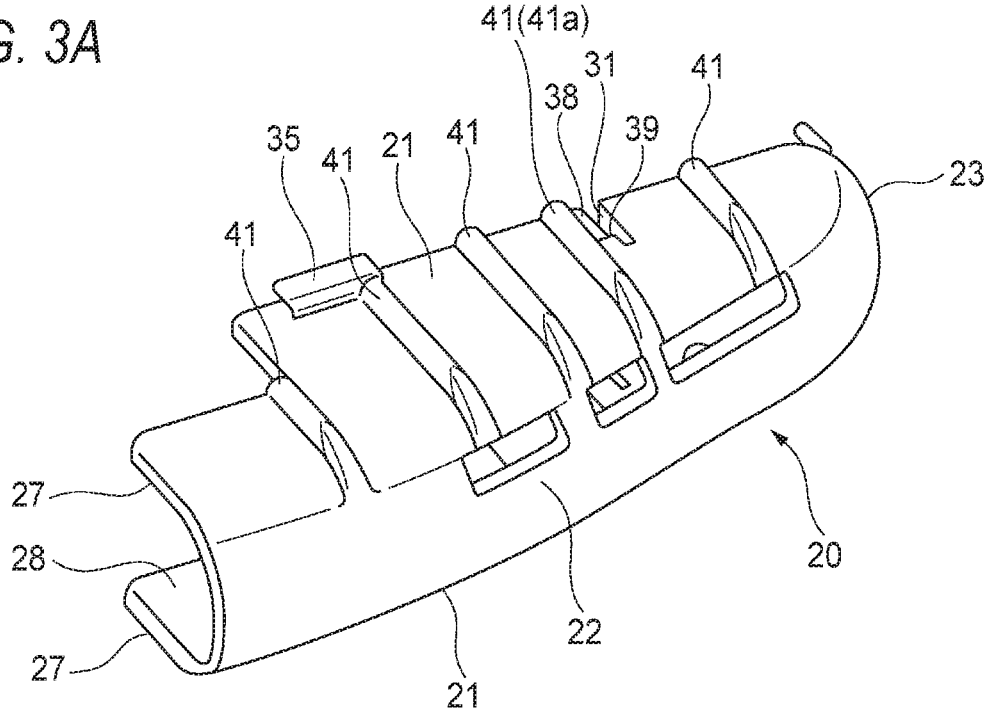
FIG. 3A is a perspective view illustrating a cover illustrated in FIG. 1 when viewed from the rear side.
Figure 3B:
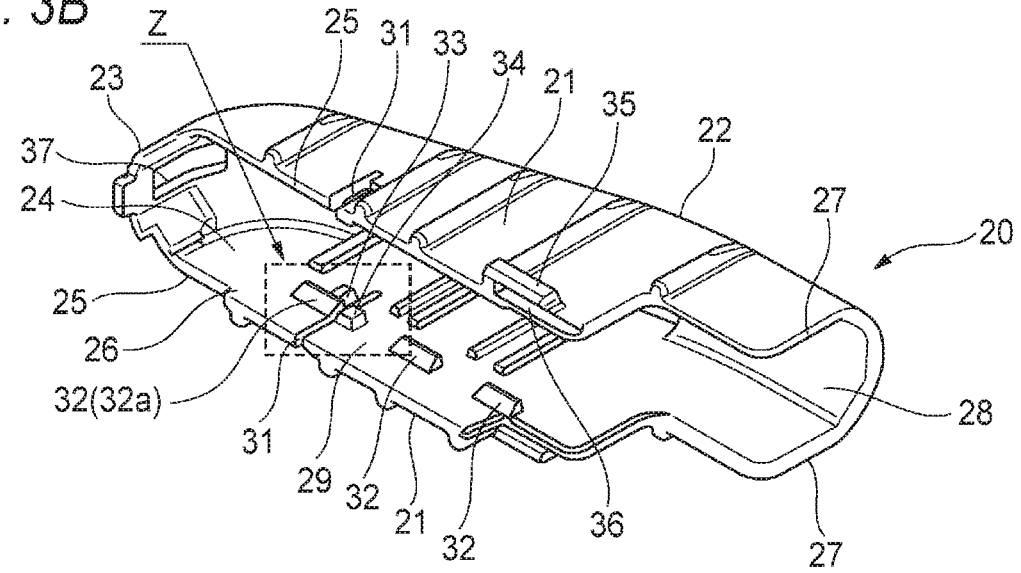
FIG. 3B is a perspective view illustrating the cover illustrated in FIG. 1 when viewed from the front side.
Figure 3C:
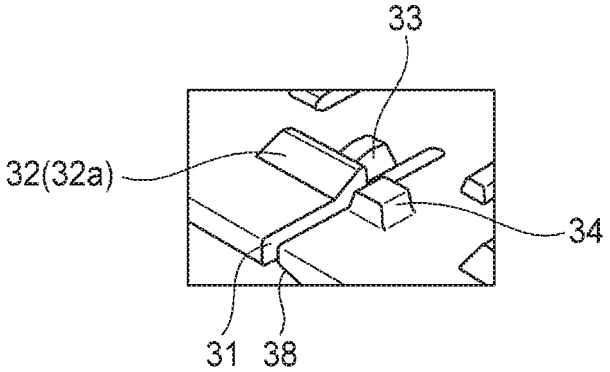
FIG. 3C is an enlarged view illustrating Z portion of FIG. 3B.

As illustrated in FIGS. 3A to 3C, the cover 20 is made of resin, and includes a pair of plate-shaped parts 21 which face each other with a gap in the vertical direction, a connection part 22 which connects the rear end sides of a pair of plate-shaped parts 21, and a closing plate part 23 which closes the closing side continuously with the closing sides of the pair of plate-shaped parts 21 and the connection part 22. A space 24 defined by the pair of plate-shaped parts 21, the connection part 22, and the closing plate part 23 is a space for receiving and guiding the wire bundle W (see FIG. 1).

The opening between a pair of front end surfaces 25 which extend in the width direction of the pair of plate-shaped parts 21 functions as an inlet part 26 which introduces the wire bundle W to the space 24. The opening between a pair of discharging-side end surfaces 27 which extend in the front and rear direction of the pair of plate-shaped parts 21 functions as an outlet part 28 which guides and discharges the wire bundle W introduced from the inlet part 26 in the discharging direction.

In the front end parts of the pair of plate-shaped parts 21, a pair of inner wall surfaces 29 and the pair of front end surfaces 25 which extend in the width direction are guided by the pair of first guide surfaces 14 and the pair of second guide surfaces 15 of the housing 10 at the time of attaching the cover 20, respectively.

In the plate-shaped part 21, a slit 31 (through hole) which extends by a predetermined length from the front end surface 25 toward the rear side is formed near the center in the width direction. In the inner wall surface 29 which extends in the width direction of the plate-shaped part 21, ridges 32 which extend by a predetermined length in the width direction are respectively formed in a first position near the slit 31 on the closing side from the slit 31, a second position slightly separate from the slit 31 on the discharging side from the slit 31, and a third position slightly separate on the discharging side from the second position, so as to be in parallel with a gap in the width direction. Incidentally, the slit 31 is provided in a place between a fourth projection 33 and a protrusion part 35 (to be illustrated below).

In the inner wall surface 29 of the plate-shaped part 21, the fourth projection 33 projecting inward in the vertical direction is formed in a position close to the slit 31 on the closing side from the slit 31, and a position close to the ridge 32 on the rear side from the ridge 32 of the first position (particularly, see FIG. 3C). The fourth projection 33 is adjacent to the slit 31. In the inner wall surface 29 of the plate-shaped part 21, a fifth projection 34 projecting inward in the vertical direction is formed to be in parallel with the ridge 32 of the first position in the width direction in a position close to the slit 31 on the discharging side from the slit 31 (particularly, see FIG. 3C). As illustrated below, the ridge 32 functions to prevent that the cover 20 is deviated to the rear side after attachment, the fourth projection 33 functions to prevent that the cover 20 escapes to the closing side after attachment, and the fifth projection 34 functions to facilitate an operation when the cover 20 is detached by using the jig 50 (see FIG. 7 and the like). Incidentally, the fifth projection 34 can also be referred to as a projection part which is provided in the inner wall surface 29 of the cover 20 to reduce a gap between the cover 20 and the outer wall surface of the housing 10.

The protrusion parts 35 which project to the vertical outer sides and extend in the width direction are formed in the discharging-side end part of the outer wall surface which extends in the width direction in the front end part of the plate-shaped part 21. A groove 36 which is opened to the front side and the discharging side and extends in the width direction is formed inside the protrusion part 35. A window 37 (penetration hole) is formed in the closing plate part 23. As illustrated below, the pair of grooves 36 function to prevent that the cover 20 is opened in the vertical outer sides after attachment, and the window 37 functions to prevent that the cover 20 is deviated to the rear side after attachment. The protrusion part 35 is provided in a position close to the outlet part 28 from the fourth projection 33.

In the outer wall surface extending in the width direction in the front end part of the plate-shaped part 21, an inclined surface 38 which is inclined such that the surface is positioned close to the vertical outer side while moving from the slit 31 to the discharging side is formed in a portion close to the slit 31 on the discharging side from the slit 31, so as to extend by a length shorter than the length of the slit 31 from the front end surface 25 toward the rear side. As a result, an end surface 39 directed to the front side is formed in the rear end position of the inclined surface 38. As illustrated below, the inclined surface 38 and the end surface 39 function to facilitate the operation when the cover 20 is detached by using the jig 50. The inclined surface 38 is positioned on the back side of the fifth projection 34 with respect to the plate-shaped part 21 (see FIG. 3C).

In the outer wall surface of the plate-shaped part 21, the ribs 41 which project to the vertical outer side and extend in the front and rear direction are formed in a plural places (in this example, five places) different in the width direction, respectively. One (hereinafter, particularly referred to as "a rib 41*a*") of the plurality of ribs 41 extends in the front and rear direction in a portion close to the inclined surface 38 on the discharging side from the inclined surface 38 in the width direction. The rib 41 functions to improve the rigidity of the plate-shaped part 21. Further, as illustrated below, the rib 41*a* also functions to facilitate the operation when the cover 20 is detached by using the jig 50.

Next, the operation that attaches the cover 20 in the housing 10 will be described with reference to FIGS. 4A to 6.

Figure 4A:
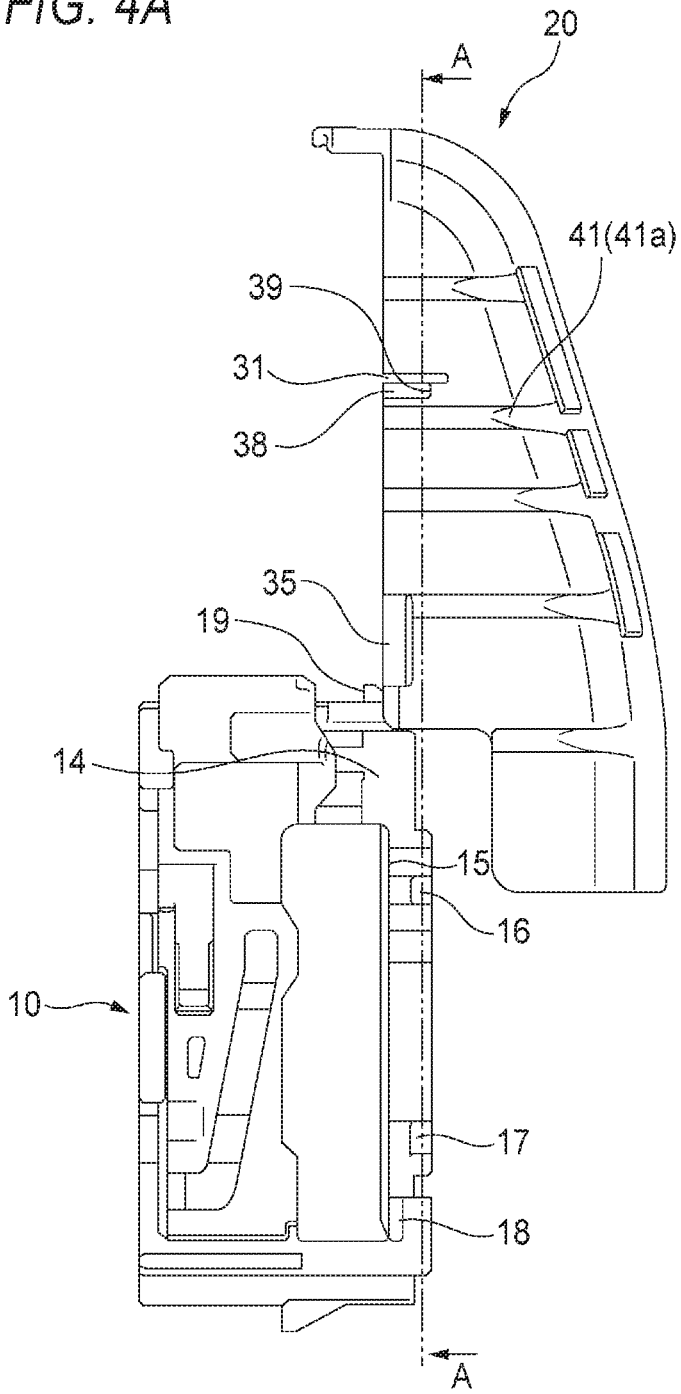
FIG. 4A is a top view illustrating a state where the cover begins to be attached in the housing.
Figure 4B:
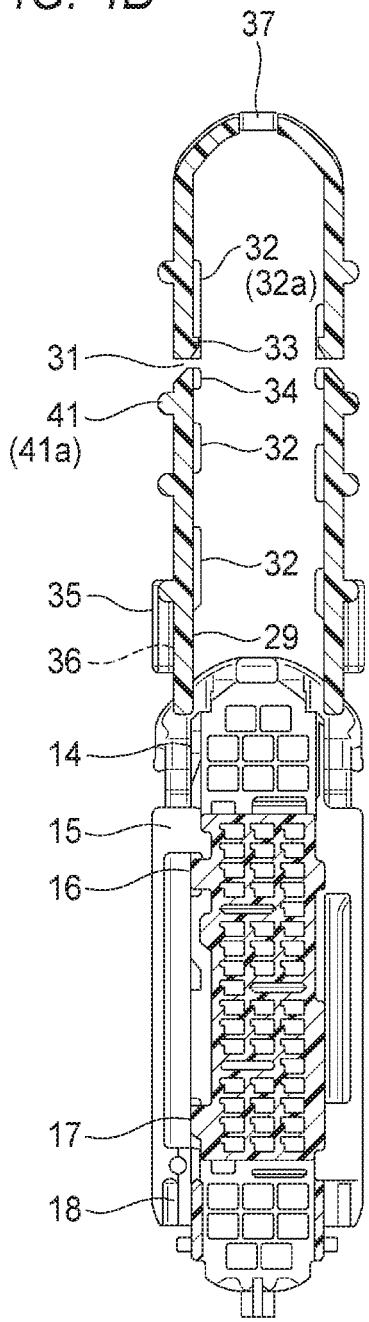
FIG. 4B is a sectional view taken along line A-A of FIG. 4A.

First, as illustrated in FIGS. 4A and 4B, the cover 20 is arranged on the closing side with respect to the housing 10. Next, the pair of inner wall surfaces 29 and the pair of front end surfaces 25 of the cover 20 are slid on the pair of first guide surfaces 14 and the pair of second guide surfaces 15 of the housing 10, respectively, and the cover 20 is slid (moves in parallel) with respect to the housing 10 toward the discharging side. Accordingly, in a state where the ridge 32 of the cover 20 is positioned on the front side from the first projection 16 and the second projection 17 of the housing 10, and the fourth projection 33 of the cover 20 has the same position in the front and rear direction as that of the first projection 16 of the housing 10, the cover 20 is slid to be guided to the first guide surface 14 and the second guide surface 15.

Figure 5A:
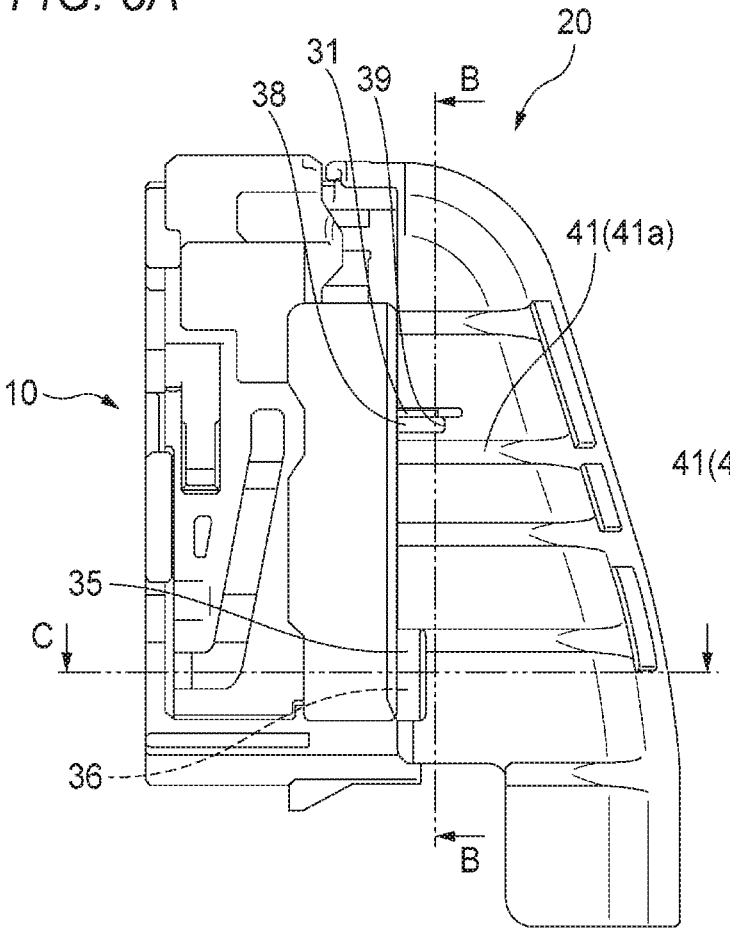
FIG. 5A is a top view illustrating a state where the cover is completely attached in the housing.
Figure 5B:
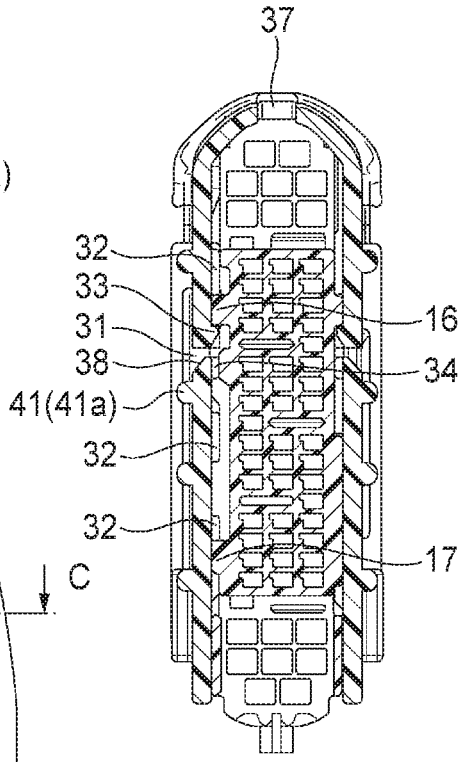
FIG. 5B is a sectional view taken along line B-B of FIG. 5A.
Figure 6:
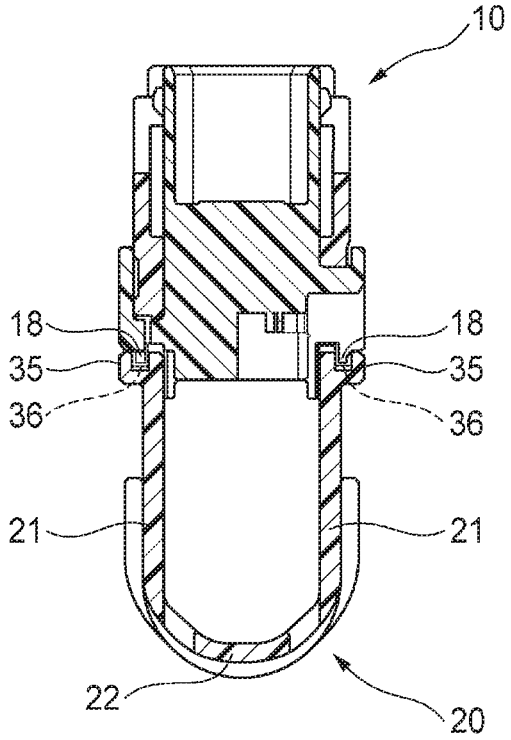
FIG. 6 is a sectional view taken along line C-C of FIG. 5A.

When the cover 20 is slid to reach the vicinity of an attachment completing position, the fourth projection 33 of the cover 20 abuts on the first projection 16 of the housing 10. In that state, when the cover 20 is slid further, the pair of plate-shaped parts 21 of the cover 20 are elastically deformed to the vertical outer sides, and the fourth projection 33 is ridden on the first projection 16. Thereafter, the pair of plate-shaped parts 21 is elastically recovered, and the fourth projection 33 is ridden over the first projection 16 (the fourth projection 33 is engaged with the first projection 16 on the discharging side of the first projection 16). As illustrated in FIGS. 5A and 5B, when the fourth projection 33 is ridden over the first projection 16, the cover 20 reaches the attachment completing position (attachment completing state). In that state, the fourth projection 33 is positioned on the outside from the outer wall surface of the housing 10. In other words, the fourth projection 33 is not covered with the housing 10.

When the fourth projection 33 is ridden over the first projection 16, the pair of grooves 36 of the cover 20 are fitted in the pair of ribs 18 of the housing 10 (see FIG. 6), and the window 37 of the cover 20 is engaged with the third projection 19 of the housing 10.

As a result, in the attachment completing state of the cover 20, the fourth projection 33 of the cover 20 and the first projection 16 of the housing 10 are engaged to prevent that the cover 20 escapes to the closing side. The pair of grooves 36 of the cover 20 are fitted in the pair of ribs 18 of the housing 10, so as to prevent that of the pair of plate-shaped parts 21 of the cover 20 are opened to the vertical outer sides. The ridge 32 of the first position of the cover 20 and the ridge 32 of the third position are engaged with the first projection 16 and the second projection 17 of the housing 10, respectively, so as to prevent that the cover 20 is deviated to the rear side. The window 37 of the cover 20 is engaged with the third projection 19 of the housing 10, so as to prevent that the cover 20 is deviated to the rear side.

Hereinbefore, in the connector 1 according to the embodiment of the invention, the fourth projection 33 of the cover 20 and the first projection 16 of the housing 10 are engaged in a position on the closing side from a portion where the opening of the discharging-side portion of the pair of plate-shaped parts 21 which are easily opened to the vertical outer sides is prevented by fitting the pair of grooves 36 of the cover 20 in the pair of ribs 18 of the housing 10. As a result, the portions where the fourth projections 33 of the pair of plate-shaped parts 21 are positioned are hardly opened to the vertical outer sides, and thus the cover 20 hardly escapes to the closing side.

The positions where the pair of grooves 36 of the cover 20 are fitted in the pair of ribs 18 of the housing 10 are separated in the width direction from the positions where the fourth projections 33 of the cover 20 are engaged in the first projections 16 of the housing 10, and thus it is possible to reduce a pressing force, which is required to ride the fourth projection 33 over the first projection 16 in a state where the pair of grooves 36 are fitted in the pair of ribs 18, of the cover 20 to the discharging side.

The slits 31 are formed in the pair of plate-shaped parts 21 of the cover 20, and the fourth projection 33 is positioned on the closing side of the slit 31, and the groove 36 is positioned on the discharging side of the slit 31. Thus, when the fourth projection 33 is ridden over the first projection 16, the portion where the groove 36 of the pair of plate-shaped parts 21 is positioned is hardly opened to the vertical outer side. For this reason, the pair of grooves 36 are easily fitted in the pair of ribs 18.

In each of the pair of plate-shaped parts 21 of the cover 20, the fourth projection 33 is formed in a position on the closing side from the slit 31. Thus, even if the external force unintentionally acts to the vertical outer sides on the portions on the discharging side from the slits 31 of the pair of plate-shaped parts 21, the fourth projections 33 are hardly opened to the vertical outer sides. For this reason, the cover 20 hardly escapes to the closing side.

Figure 7:
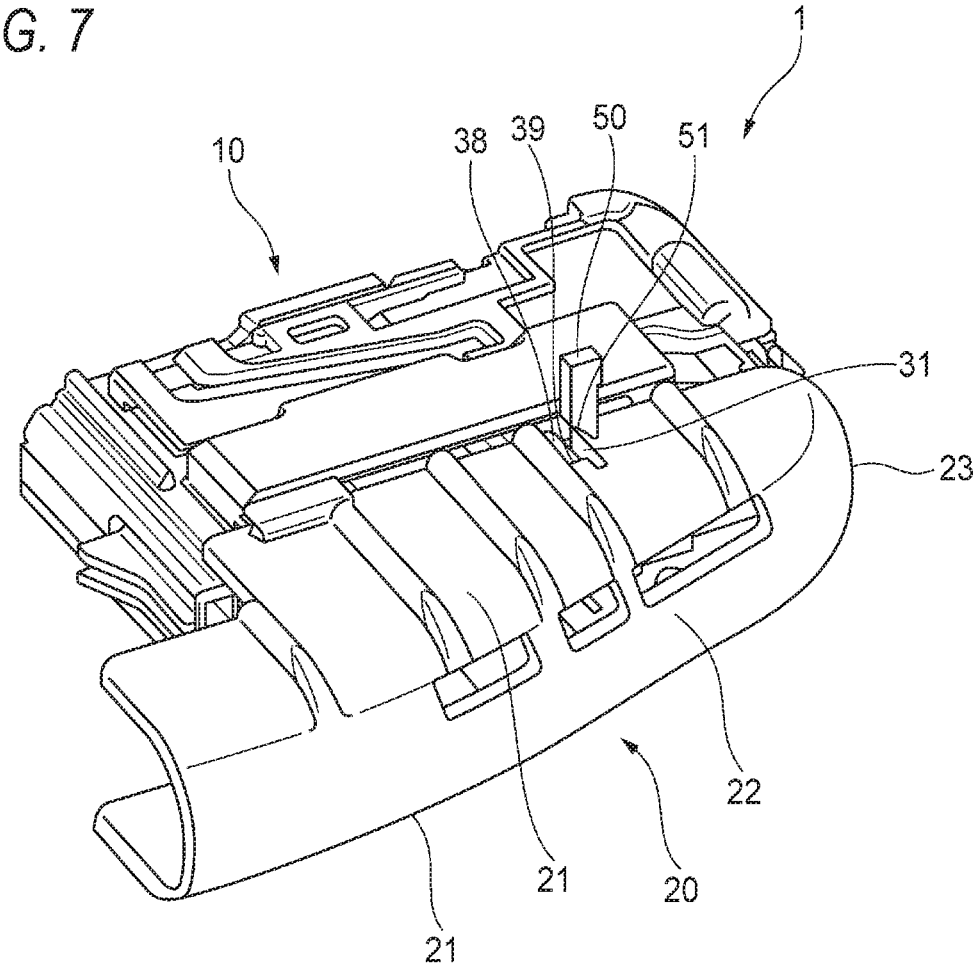
FIG. 7 is a perspective view illustrating an aspect where the cover is detached from the housing by using a cover detachment jig.
Figure 8A:
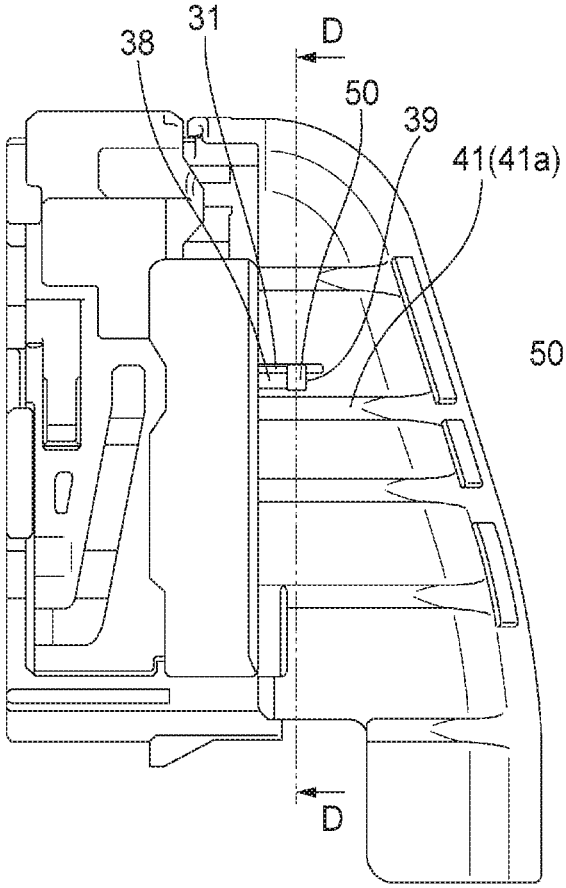
FIG. 8A is a top view illustrating an aspect where the cover is detached from the housing by using the cover detachment jig.
Figure 8B:
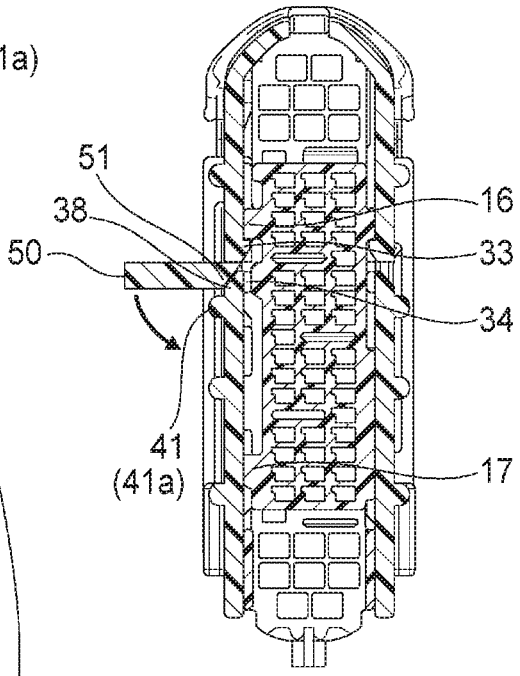
FIG. 8B is a sectional view taken along line D-D of FIG. 8A.

In the plate-shaped part 21 of the cover 20, the fourth projection 33 is formed in a position close to the slit 31. Thus, as illustrated in FIGS. 7 to 8B, the cover 20 can be easily detached from the housing 10 by using the cover detachment jig 50. Hereinafter, the description will be given about such a point.

As illustrated in FIG. 7, the jig 50 is made of resin, and includes an inclined surface 51 on one end side. As illustrated in FIGS. 7 to 8B, one end side of the jig 50 is inserted into the slit 31 of the cover 20. At that time, the jig 50 is arranged such that the inclined surface 51 of the jig 50 abuts on the inclined surface 38 of the cover 20, and the side surface of the jig 50 abuts on the end surface 39 of the cover 20. Accordingly, the insertion position and the insertion posture of the jig 50 are stabilized. Thus, it is possible to prevent the cover 20 is unintentionally damaged by the jig 50.

As indicated by an arrow in FIG. 8B, the jig 50 is rotated in such a state where the jig 50 is inserted into the slit 31. Accordingly, the jig 50 is rotated with the inclined surface 51 (the edge of the slit 31) as a support point, and the fourth projection 33 is opened to the vertical outer side (a direction to be separated from the housing 10) by the pressure of the jig 50, thereby releasing the engagement between the fourth projection 33 and the first projection 16. As a result, the cover 20 can move on the housing 10 to the closing side, and the cover 20 can be detached from the housing 10.

Herein, in the plate-shaped part 21 of the cover 20, the fifth projection 34 is formed on the back side of the inclined surface 38 (see FIG. 3C). In the attachment completing state of the cover 20, the fifth projection 34 abuts on the first guide surface 14 of the housing 10. For this reason, although a force acts on the inclined surfaces 38 to the vertical inner sides when the jig 50 rotates, it is prevented that the inclined surfaces 38 are pressed by the housing 10 to move to the vertical inner sides. For this reason, it is prevented that the inclined surfaces 38 move to the vertical inner sides so as to reduce the moving amount of the fourth projections 33 to the vertical outer sides with respect to the rotating angle of the jig 50. Thus, the cover is easily detached by the jig 50. Further, since the rib 41 is provided on the front side of the jig 50 in a rotating direction, it can be prevented that the jig 50 rotates excessively to apply an excessive external force to the fourth projection 33.

Incidentally, the invention is not limited to the above-described embodiment, and various modifications may be adopted within a range of the invention. For example, the invention is not limited to the above-described embodiment, and a modification, a variation or the like is allowed. In addition, material, shape, size, number, location or the like of each component in the above-described embodiment are arbitrary and not limited as long as they can attain the present invention.

For example, in the above-described embodiment, the cover 20 is mounted with respect to the housing 10 by sliding (moving in parallel) the cover 20 on the housing 10 to the discharging side. However, the cover 20 may be configured to be mounted in the housing 10 by sliding (moving in parallel) the cover 20 on the housing 10 toward the front side.

Further, in the above-described embodiment, the fifth projection 34 (projection part) is configured as a place (thick place) in which the thickness of the plate-shaped part 21 is large compared to the place different from the place provided with the fifth projection 34. However, the fifth projection 34 (projection part) is not necessarily such a thick place. For example, the fifth projection 34 (projection part) may be configured to be a place (embossing place) in which part of the plate-shaped part 21 is curved and projects toward the housing 10 while the thickness of the plate-shaped part 21 is constant. In addition, the fifth projection 34 (projection part) may be configured to be a place in which a member different from the plate-shaped part 21 is stuck to the inner wall surface of the cover 20.

Herein, the features of the embodiments of the connector according to the invention will be simply summarized as the following [1] to [4].

(1) A connector (1) comprising:

a housing (10) which is capable of holding one or more electric wires; and a cover (20) which is attached to an end part of the housing while sliding in a sliding direction and guides the electric wire extending from the end part of the housing in a predetermined direction, wherein the cover (20) includes:

a pair of plate-shaped parts (21) and a connection part (22) connecting the pair of plate-shaped parts;

an inlet part (26) which is formed on circumferential edge portions of the pair of plate-shaped parts and introduces the electric wire to an space between the pair of plate-shaped parts, and an outlet part (28) which is formed on circumferential edge portions of the pair of plate-shaped parts and derives the electric wire outside therefrom so as to guide the electric wire in the predetermined direction;

a first locking part (33) which is engaged with the housing to regulate sliding of the cover in a direction opposite to the sliding direction; and a second locking part (35) which is engaged with the housing to regulate widening of a distance between the pair of plate-shaped parts, wherein the first locking part (33) is positioned on an outside from an outer wall surface of the housing, and wherein the second locking part (35) is positioned closer to the outlet part than the first locking part.

(2) The connector according to (1), wherein the cover (20) includes an opening part (31) extending from an edge of the plate-shaped part between the first locking part (33) and the second locking part (35).

(3) The connector according to (2), wherein the first locking part (33) is positioned adjacent to the opening part (31) in the plate-shaped part.

(4) The connector according to (3), wherein the cover (20) includes a projection part (34) on an inner wall surface of the cover to reduce a gap between the cover and the outer wall surface of the housing, on an opposite side to the first locking part (33) across the opening part (31).

(5) The connector according to according to (3), wherein the housing (10) includes a projection part (34) on the outer wall surface of the housing to reduce a gap between the cover and the outer wall surface of the housing, on a position corresponding to an opposite side to the first locking part (33) across the opening part (31).

(6) The connector according to according to (2), wherein the opening part has a slit shape or an ellipse shape.

DESCRIPTION OF REFERENCE NUMERALS AND SIGNS

1: Connector
10: Housing
20: Cover
21: Plate-shaped part
22: Connection part
24: Space
26: Inlet part
28: Outlet part
31: Slit (opening part)
33: Fourth projection (first locking part)
34: Fifth projection (projection part)
35: Protrusion part (second locking part)

What is claimed is:

1. A connector comprising:

a housing which is capable of holding one or more electric wires; and a cover which is attached to an end part of the housing while sliding toward one side of a sliding direction and guides the one or more electric wires extending from the end part of the housing in a predetermined direction, wherein the housing includes:

a first locked part positioned on an outer wall of the end part, and a second locked part positioned at a position in a predetermined direction side relative to the first locked part on the outer wall of the end part, wherein the cover includes:

a pair of plate-shaped parts, a connection part connecting the pair of plate-shaped parts, and a closing plate part which closes an opposing side to the predetermined direction side of the cover and which is continuously positioned at the pair of plate-shaped parts and the connection part;

an inlet part which is formed on first circumferential edge portions of the pair of plate-shaped parts and introduces the electric wire to a space between the pair of plate-shaped parts, the pair of plate-shaped parts facing each other across the space in a width direction;

an outlet part which is formed on second circumferential edge portions of the pair of plate-shaped parts and derives the electric wire outside therefrom so as to guide the electric wire in the predetermined direction;

a first locking part which is engaged with the first locked part of the housing to prevent sliding of the cover toward the other side of the sliding direction; and a second locking part which is engaged with the second locked part of the housing to prevent widening of a distance in the width direction between the pair of plate-shaped parts, wherein the first locked part of the housing is positioned on an outside in the width direction from a surface of the outer wall of the end part of the housing, wherein the second locked part of the housing is positioned closer to the outlet part than the first locked part of the housing, wherein the end part of the housing extends along a direction parallel to the sliding direction, wherein the cover is attached to the end part of the housing while a pair of inner wall surfaces of the pair of plate-shaped parts slide on a pair of the outer wall surfaces of the housing, wherein the cover includes an opening part extending from an edge of the pair of plate-shaped parts between the first locking part of the cover and the second locking part of the cover and according to the inlet part, wherein the second locking part of the cover and the opening part are separated in the sliding direction, wherein one of the first locking part of the cover and the second locking part of the cover is disposed adjacent to the opening part, wherein the other of the first locking part of the cover and the second locking part of the cover is spaced apart from the opening part in the sliding direction, and wherein the first locking part is disposed farther away, in a direction perpendicular to the sliding direction, from a surface of the end part of the housing and from which the one or more wires protrude than the second locking part is to the surface of the end part of the housing in the direction perpendicular to the sliding direction.

* * * * *